US007531493B2

(12) United States Patent
Schroeder et al.

(10) Patent No.: US 7,531,493 B2
(45) Date of Patent: May 12, 2009

(54) KIT FOR CARING FOR A FABRIC ARTICLE

(75) Inventors: John Gregory Schroeder, Kobe (JP); Nobuhiko Honma, Fukaekita-machi (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/862,830

(22) Filed: May 22, 2001

(65) Prior Publication Data

US 2002/0019328 A1 Feb. 14, 2002

Related U.S. Application Data

(60) Provisional application No. 60/206,075, filed on May 22, 2000.

(51) Int. Cl.
*C11D 17/04* (2006.01)

(52) U.S. Cl. ..... 510/277; 510/406; 510/439; 510/519; 510/520; 510/523

(58) Field of Classification Search ..... 510/277, 510/439, 406, 519, 520, 523
See application file for complete search history.

(56) References Cited

U.S. PATENT DOCUMENTS

| | | | | | |
|---|---|---|---|---|---|
| 3,650,816 | A | | 3/1972 | Rudy et al. | 117/109 |
| 3,842,976 | A | * | 10/1974 | Dea | 206/203 |
| 3,890,242 | A | * | 6/1975 | Curry | 514/188 |
| 4,026,131 | A | | 5/1977 | Dugger et al. | 68/17 |
| 4,099,912 | A | | 7/1978 | Ehrlich | 8/137 |
| 4,139,114 | A | | 2/1979 | Long et al. | 220/23.4 |
| 4,504,407 | A | * | 3/1985 | Klutz et al. | 510/278 |
| 4,511,495 | A | * | 4/1985 | Melville | 510/520 |
| 4,563,186 | A | | 1/1986 | Flynn et al. | |
| 4,618,444 | A | * | 10/1986 | Hudson et al. | 8/111 |
| 4,636,328 | A | | 1/1987 | Flynn et al. | |
| 4,654,395 | A | | 3/1987 | Schulz et al. | |
| 4,659,496 | A | | 4/1987 | Klemm et al. | |
| 4,720,351 | A | | 1/1988 | Flynn et al. | |
| 4,765,916 | A | | 8/1988 | Ogar, Jr. et al. | |
| 4,776,972 | A | * | 10/1988 | Barrett | 252/186.38 |
| 4,835,804 | A | | 6/1989 | Arnau-Munoz et al. | 8/158 |
| 4,973,416 | A | * | 11/1990 | Kennedy | 510/296 |
| RE33,646 | E | | 7/1991 | Klemm et al. | |
| 5,064,073 | A | * | 11/1991 | Folland | 220/521 |
| 5,080,810 | A | | 1/1992 | Smith et al. | |
| 5,132,036 | A | * | 7/1992 | Falou et al. | 510/277 |
| 5,160,654 | A | * | 11/1992 | Falou et al. | 510/277 |
| 5,202,045 | A | * | 4/1993 | Karpusiewicz et al. | 510/277 |
| 5,207,933 | A | * | 5/1993 | Trinh et al. | 510/517 |
| 5,490,608 | A | * | 2/1996 | Hawkins | 220/524 |
| 5,552,378 | A | * | 9/1996 | Trinh et al. | 512/3 |
| 5,746,353 | A | * | 5/1998 | Cheok et al. | 222/132 |
| 5,817,614 | A | | 10/1998 | Miracle et al. | 510/376 |
| 5,891,197 | A | | 4/1999 | Young et al. | 8/137 |
| 6,013,614 | A | | 1/2000 | Mahdessian | 510/277 |
| 6,015,781 | A | * | 1/2000 | Vinson et al. | 510/302 |
| 6,105,812 | A | * | 8/2000 | Riordan | 220/504 |
| 6,390,324 | B1 | * | 5/2002 | Everette et al. | 220/555 |
| 6,410,496 | B1 | * | 6/2002 | Masschelein et al. | 510/277 |

FOREIGN PATENT DOCUMENTS

| | | | |
|---|---|---|---|
| EP | 157653 | A2 | 10/1985 |
| EP | 233027 | A2 | 8/1987 |
| EP | 284191 | A2 | 9/1988 |
| EP | 918089 | A1 | 5/1999 |
| GB | 2355245 | A | 4/2001 |
| WO | WO 96/30489 | | 10/1996 |
| WO | WO 98/05814 | | 2/1998 |
| WO | WO 98/16614 | | 4/1998 |
| WO | WO 99/27055 | | 6/1999 |

* cited by examiner

*Primary Examiner*—Lorna M Douyon
(74) *Attorney, Agent, or Firm*—Jason J. Camp; David V. Upite; Ronald T. Sia

(57) ABSTRACT

A kit for caring for a fabric article includes multiple products such as a fabric treatment composition and a laundry detergent composition, a fabric conditioning composition, and/or a second fabric treatment composition. Each of the multiple products contains a coordinated element, such as a brand name, a characteristic ingredient, container graphics, containers, dosages per container, a dye, a perfume, a trade dress, a set of usage instructions, and a combination thereof.

8 Claims, No Drawings

KIT FOR CARING FOR A FABRIC ARTICLE

CROSS REFERENCE TO RELATED APPLICATION

This application claims benefit to U.S. Provisional Application Ser. No. 60/206,075 dated May 22, 2000 by J. G. Schroeder, et al.

FIELD OF THE INVENTION

The present invention relates to a composition for cleaning a fabric article. Specifically, the present invention relates to a laundry detergent composition, a fabric conditioning composition and a fabric treatment composition.

BACKGROUND OF THE INVENTION

It is known to clean a fabric article, such as clothing, by laundering it with a laundry detergent composition, and softening it by, for example, applying a fabric conditioning composition thereto. Furthermore, it is also known to employ other fabric treatment compositions to a fabric article for specific purposes, such as a pre-treater to remove stains, a starch to stiffen the fabric upon ironing, etc.

Accordingly, there exist many, many laundry detergent compositions, fabric conditioning compositions, and fabric treatment compositions for the consumer to choose from. Each of these fabric care products is typically provided separately, with little or no indication as to what products are preferred for use together. This, in turn, provides the consumer with an immense number of fabric treatment combinations to choose from, even if they just use three fabric care products, such as a laundry detergent, a fabric conditioning composition, and a single fabric treatment composition. In fact, for these three products, the typical number of potential combinations in even a single small store can easily approach a hundred, or more. With each additional fabric treatment composition which a consumer uses, the number of possible choices expands, dramatically, if not exponentially. Thus, a consumer may be intimidated by the sheer number of choices available. Furthermore, in order to find the best fabric care results, the consumer may have to try many combinations of products. Given this immense task and the expense of purchasing many products, a consumer will typically settle for inferior results.

In addition, it is possible that many fabric care products are not specifically designed for use together. Thus, the information in their instructions may conflict and/or be confusing to the consumer. As such, actual damage to the fabric article may occur if incompatible fabric care products inadvertently interact and/or cross-react. For example, an anionic surfactant and a cationic fabric conditioning agent may form insoluble precipitates when they are inadvertently combined.

The hair care industry has addressed this complexity by developing hair care kits, systems, and methods for treating hair which provide a plurality of products which may synergistically work together to provide a better hair care result. For example, a hair care kit may include a hair shampoo, a hair conditioner, and an adjunct hair care component such as a hair straightener, a hair dye, a hair bleach, etc. Similar approaches have been developed in the cosmetics and skin care industry. However, such a systematic approach has not been applied in the fabric care industry.

Accordingly, the need exists for an improved kit for caring for a fabric article. The need also exists for an easy, clear product for achieving improved fabric care results. Finally, the need exists for a kit for reducing consumer confusion about the multitude of fabric care combinations available, while minimizing the possibility of undesirable product interactions.

SUMMARY OF THE INVENTION

The present invention relates to a kit for caring for a fabric article which includes a laundry detergent composition in a laundry detergent composition container and/or a fabric conditioning composition in a fabric conditioning composition container, and a fabric treatment composition in a fabric treatment composition container. The fabric treatment composition is a bleaching composition, a color fixative composition, a dryer sheet composition, a finishing composition, a pretreating composition, or a combination thereof. Also, the fabric treatment composition and the laundry detergent composition and/or fabric conditioning composition include a coordinated element, such as a brand name, a characteristic ingredient, container graphics, containers, dosages per container, a dye, a perfume, a trade dress, a set of usage instructions, or a combination thereof.

In another embodiment, a first fabric treatment composition in a first fabric treatment composition container and a second fabric treatment composition in a second fabric treatment composition container are provided. The first fabric treatment composition is different from the second fabric treatment composition, and both include a coordinated element.

It has now been found that a kit for caring for a fabric article which contains multiple products may be easy to use, and clearly understood by the consumer. Furthermore, the use of such a kit may provide one or more improved fabric care results, such as improved cleaning, whitening, softness, malodor elimination, perfume fragrance retention and release, color retention, stain removal, ease of ironing, static reduction, etc. Such benefits may be especially significant and noticeable after multi-cycle application to the same fabric article. In addition, as the multiple products therein are sold together as a fabric care kit, the present invention may significantly reduce consumer confusion regarding synergistic fabric care combinations. Furthermore, such a fabric care kit may reduce undesirable cross-reactions and interactions between incompatible ingredients. In addition, the multiple products in the present kit are typically compatible with each other, as well as with all types of natural and artificial fabric articles, such as those formed from cotton, nylon, rayon, wool, and silk, and may be advantageously personalized and/or customized to provide synergistic care for specific fabric articles, specific consumers, etc.

These and other features, aspects, advantages, and variations of the present invention, and the embodiments described herein, will become evident to those skilled in the art from a reading of the present disclosure with the appended claims, and are covered within the scope of these claims.

DETAILED DESCRIPTION OF THE INVENTION

All percentages, ratios and proportions herein are by weight, unless otherwise specified. All temperatures are in degrees Celsius (° C.) unless otherwise specified. All documents cited are incorporated herein by reference in their entireties. Citation of any reference is not an admission regarding any determination as to its availability as prior art to the claimed invention.

As used herein, the term "alkyl" means a hydrocarbyl moiety which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, the term "fabric article" means any fabric or fabric-like item which is laundered, conditioned, or treated on a regular, or irregular basis. Non-limiting examples of a fabric article include clothing, curtains, bed linens, wall hangings, textiles, cloth, etc. Preferably, the fabric article is a woven article, and more preferably, the fabric article is a woven article such as clothing. Furthermore, the fabric article may be made of natural and artificial materials, such as cotton, nylon, rayon, wool, and silk.

As used herein, the term "in combination with" means that the referred-to composition is applied to the same fabric article as another composition. The referred-to composition may be applied directly to the fabric article, e.g., in neat form, and/or indirectly, e.g., in diluted form, as appropriate. According to the usage of this term herein, the referred-to composition may be used before another composition, at the same time as another composition, and/or after another composition, as appropriate.

As used herein, the term "multiple products" refers to the fabric treatment composition in the fabric treatment composition container, the laundry detergent composition in the laundry detergent composition container, the fabric conditioning composition in a fabric conditioning container, the second fabric treatment composition in the second fabric treatment composition container, etc. which are contained in the kit of the present invention.

Laundry Detergent Composition

A laundry detergent composition is provided in the kit of the present invention. The laundry detergent composition useful herein is used in laundering a fabric article to remove undesirable materials such as dirt, oils, chemicals, body soils, etc. The fabric article is laundered with the laundry detergent composition. Accordingly, the laundry detergent composition contains at least one detersive surfactant selected from the group consisting of an amphoteric surfactant, an anionic surfactant, a cationic surfactant, a nonionic surfactant, a zwitterionic surfactant, and combinations thereof.

Nonlimiting examples of detersive surfactants useful in the detergent composition include, the conventional $C_{11}$-$C_{18}$ alkyl benzene sulfonates and primary, branched-chain and random $C_{10}$-$C_{20}$ alkyl sulfates, the $C_{10}$-$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$-$C_{18}$ alkyl alkoxy sulfates; especially EO 1-7 ethoxy sulfates), $C_{10}$-$C_{18}$ alkyl alkoxy carboxylates (especially the EO 1-5 ethoxycarboxylates), the $C_{10-18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates including the so-called narrow peaked alkyl ethoxylates and $C_6$-$C_{12}$ alkyl phenol alkoxylates (especially ethoxylates and mixed ethoxy/propoxy), $C_{12}$-$C_{18}$ betaines and sulfobetaines, $C_{10}$-$C_{18}$ amine oxides, and the like, can also be included in the overall compositions. The $C_{10}$-$C_{18}$ N-alkyl polyhydroxy fatty acid amides can also be used. Typical examples include the $C_{12}$-$C_{18}$ N-methylglucamides. See WO 92/06154 to Cook, et al., published Apr. 16, 1992. Other sugar-derived surfactants include the N-alkoxy polyhydroxy fatty acid amides, such as $C_{10}$-$C_{18}$ N-(3-methoxypropyl) glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Preferably, the laundry detergent composition comprises, by weight, at least about 0.01%; more preferably at least about 0.1%; even more preferably at least about 1%; and even more preferably still, from about 1% to about 55% detersive surfactant.

In addition to a detersive surfactant, a laundry detergent composition may further contain one or more adjunct ingredients such as an anti-redeposition agent, a bleach, a bleach activator, a brightener, a builder, a carrier, a chelant, a clay soil removal agent, a dispersant, a dye, a dye-transfer inhibitor, an enzyme, an enzyme stabilization system, a fabric softening active, a filler, a hydrotrope, a perfume, a processing aid, a soil release polymer, a solvent, a suds booster, a suds supressor, etc.

While the laundry detergent composition may contain one or more adjunct ingredients, for example, a fabric softening active, it is distinguished from a fabric conditioning composition in that a laundry detergent composition is applied to the fabric in the wash cycle, and thus, its primary function is to clean and remove undesirable materials from the fabric article.

The laundry detergent composition is not limited in physical form, and may be a granule, a powder, a liquid, a gel, a paste, a tablet, or a bar. Preferably, the laundry detergent composition's form is a granule, a powder, a liquid, or a gel, and more preferably, the laundry detergent composition is a laundry detergent shampoo composition in a liquid, or a gel form. Without intending to be limited by theory, it is believed that a liquid or a gel form may be more gentle on the fabric article, may be more soluble at low temperatures, and/or may be more effective on enzyme-susceptible soils.

Specific, non-limiting examples of a laundry detergent composition and/or a laundry shampoo composition useful herein include those described in, for example, WO 95/33044 to Vinson, et al., published on Dec. 7, 1995; WO 99/09126 to Bettiol, et al., published on Feb. 25, 1999; PCT Patent Application No. U.S. Ser. No. 00/00839 to Showell, et al., filed on Jan. 13, 2000; U.S. Pat. No. 5,916,862 to Morelli, et al., issued on Jun. 29, 1999; U.S. Pat. No. 5,565,145 to Watson, et al., issued on Oct. 15, 1996; U.S. Pat. No. 5,470,507 to Fredj, et al., issued on Nov. 28, 1995; U.S. Pat. No. 5,466,802 to Panadiker, et al., issued on Nov. 14, 1995; U.S. Pat No. 5,460,752 to Fredj, et al., issued on Oct. 24, 1995; U.S. Pat. No. 5,458,810 to Fredj, et al., issued on Oct. 17, 1995; and U.S. Pat. No. 5,458,809 to Fredj, et al., issued on Oct. 17, 1995.

The laundry detergent composition is provided in a laundry detergent composition container. The laundry detergent container will typically be a box, a bottle, and/or a pouch, which may further contain a dosing device and/or an applicator device such as a scoop, a measuring cup, a pour spout, etc. Solid and granular laundry detergent compositions are typically provided in a box, or a film pouch bottle, preferably a cardboard box or a plastic box, and more preferably a laminated cardboard box, or a plastic box. Without intending to be limited by theory, it is believed that a laminated cardboard box and/or a plastic box may be especially advantageous, as these boxes may be easily recyclable, and may also be adjusted to provide desirable properties, such as a watertight seal, moisture resistance, reclosability, etc. Liquid and gel-type laundry detergent compositions are preferably provided within a plastic bottle, more preferably a recyclable plastic bottle such as a polyethylene and/or polypropylene bottle, and/or a laminated film pouch.

Fabric Conditioning Composition

A fabric conditioning composition is provided in the kit of the present invention. The fabric conditioning composition useful herein is applied to the surface and/or the interior of a fabric article to modify the properties of the fabric article and to provide one or more benefits such as softness, skin comfort, reduced static, increased fluffiness, improved fiber and color maintenance, reduced wrinkling, reduced tangling, reduced surface friction, etc. The fabric article is thereby conditioned with the fabric conditioning composition.

Useful fabric conditioning compositions may be in liquid, solid, gel, or sheet form, and are typically applied to a fabric article in the wash cycle, in the rinse cycle, and/or during the drying cycle. Preferably, the fabric conditioning composition is applied to the fabric in the rinse cycle, and/or in the drying cycle. In a highly preferred embodiment of the present invention, the fabric conditioning composition is a liquid fabric conditioning composition which is applied to the fabric article during the rinse cycle of a washing process.

The fabric conditioning composition typically contains from about 0.1% to about 90%, preferably from about 0.5% to about 70%, and more preferably from about 1% to about 40% of a fabric softening active such as an impalpable smectite clay, a silicone derivative, a cationic fabric softening active, and/or a mixture thereof. Preferred fabric softening actives include quaternary ammonium compounds or amine precursors thereof, cationic ammonium softening compounds, nonionic softening compounds, and mixtures thereof. More preferred fabric softening actives and fabric conditioning compositions include those disclosed in U.S. Pat. No. 4,062,647 to Storm and Nirschl, issued Dec. 13, 1977; U.S. Pat. No. 4,375,416 to Crisp, et al., issued Mar. 1, 1983; U.S. Pat. No. 4,291,071 to Harris, et al., issued Sep. 22, 1981; and PCT Patent Application U.S. 99/15056 to Bryant, et al., filed on Jul. 1, 1999.

In a highly preferred embodiment, the fabric conditioning composition here is a clear, transparent, or translucent fabric conditioning composition. Specific examples of highly preferred fabric conditioning compositions include those disclosed in U.S. Pat. No. 5,747,443 to Wahl, et al., issued May 5,1998.

The fabric conditioning composition may further comprise one or more adjunct ingredients such as a solvent, a perfume, an antibacterial agent, a deposition aid, a pH buffer, a dye, an optical brightener, a viscosity/dispersability modifier, a dye transfer inhibition agent, fabric surface modifiers such as silicones and polymers, a soil release agent, a phase stabilizer, a stabilizer, and a mixture thereof. Preferred adjunct ingredients include a surfactant, a pH buffer, a viscosity modifier, a perfume, a dye, and a mixture thereof.

The fabric conditioning composition is provided in a fabric conditioning composition container, such as a box, a bottle, and/or a pouch, which may further contain a dosing device and/or an applicator device such as a scoop, a measuring cup, a pour spout, etc. Liquid and gel-type fabric conditioning compositions are preferably provided within a plastic bottle, more preferably a recyclable plastic bottle such as a polyethylene and/or polypropylene bottle. The fabric conditioning composition may also be provided in a pouch, especially a refill pouch.

Fabric Treatment Composition

In the method of the present invention, a fabric treatment composition is provided. The fabric treatment composition useful herein is selected from the group consisting of a bleaching composition, a color maintenance composition, a dryer sheet composition, a finishing composition, a pre-treating composition, and a combination thereof, preferably a bleaching composition, a color fixative composition, a finishing composition, a pre-treating composition, and a combination thereof. If a fabric conditioning composition is provided, then a dryer sheet may not be needed, and thus, the fabric treatment composition is preferably selected from the group consisting of a bleaching composition, a color fixative composition, a finishing composition, a pretreating composition, and a combination thereof. The fabric article is treated with the fabric treatment composition.

The fabric treatment composition may be provided in virtually any physical form, preferably as a liquid, a solid, a foam, a gel, or a mixture thereof. The fabric treatment composition may also be applied directly and/or indirectly to the fabric article in either a concentrated, neat, or dilute form, as desired. Without intending to be limited by theory, it is believed that that the fabric treatment composition may provide especially improved results after multi-cycle use with the laundry detergent composition and/or the fabric conditioning composition. Preferably, two or more different fabric treatment compositions are provided and/or applied to the fabric article.

The bleaching composition useful herein provides a whitening and/or a brightening effect on the fabric article, and may contain any bleach per se known in the art, either alone, or in conjunction with any bleach activators and/or bleach boosters known in the art. A preferred bleach useful herein is a halide bleach, an oxygen bleach, and a mixture thereof, more preferably an oxygen bleach. Oxygen bleaches are highly preferred as they are typically safer on fabrics, especially colored fabrics, than halide-based bleaches.

Specific, non-limiting examples of the bleaching composition useful herein include those described in U.S. Pat. No. 5,559,090 to Scialla and Cardola, issued on Sep. 24, 1996; U.S. Pat. No. 5,536,438 to Scialla, et al., issued on Jul. 16, 1996; WO 95/21122 to Rapisarda, et al., published on Aug. 10, 1995; U.S. Pat. No. 6,037,317 to Rapisarda, et al., issued on Mar. 14, 2000; WO 95/34621 to Scialla, et al., published on Dec. 21, 1995; U.S. Pat. No. 5,929,012 to Del Duca, et al., issued on Jul. 29, 1999; U.S. Pat. No. 5,910,473 to Aldano, et al., issued on Jun. 8, 1999; U.S. Pat. No. 6,001,794 to Del Duca, et al., issued on Dec. 14, 1999; WO 97/02332 to Masotti, et al., published on Jan. 23, 1997; WO 97/22407 to Bianchetti, et al., published on Jun. 26, 1997; U.S. Pat. No. 5,968,885 to Del Duca, et al., issued on Oct. 19, 1999; U.S. Pat. No. 5,641,739 to Kott and Willey, issue don Jun. 24, 1997; WO 97/47558 to Del Duca, et al., published on Dec. 18, 1997; U.S. Pat. No. 6,019,797 to Del Duca, et al., issued on Feb. 1, 2000; WO 98/11191 to Scialla, et al., published on Mar. 19, 1998; WO 98/11189 to Burns, et al., published no Mar. 19, 1998; WO 97/32962 to Del Duca, et al., published on Sep. 12, 1997; WO 98/11192 to Masotti, et al., published on Mar. 19, 1998; WO 98/18893 to Del Duca, et al., published on May 7, 1998; WO 98/22560 to Bertacchi, et al., published on May 28, 1998; WO 98/33879 to Del Duca, et al., published on Aug. 6, 1998; WO 99/18181 to Del Duca, et al., published on Apr. 15, 1999; WO 99/18179 to Del Duca, et al., published on Apr. 15, 1999; WO 99/18183 to Del Duca, et al., published on Apr. 15, 1999; WO 99/24540 to Del Duca, et al., published on May 20, 1999; WO 99/63033 to Del Duca, et al., published on Dec. 19, 1999; WO 00/12666 to Campestrini, et al., published on Mar. 9, 2000; and WO 00/15743 to Briatore, et al., published on Mar. 23, 2000.

Dyes which are released from a fabric article in the wash (i.e., "fugitive" dyes) may later redeposit on the same fabric article, or another fabric article, and lead to undesirable spotting, or discoloration. Furthermore, abrasion of the fabric article surface in the wash may lead to a dulling of the fabric article's colors. The color maintenance composition useful herein may "lock" the colored dye(s) onto the fabric article so as to protect fabric from fugitive dye redeposition in the wash cycle. The color maintenance composition may also reduce fabric abrasion in the wash. These color maintenance techniques keep the fabric article's colors brighter and/or more vivid for a longer period of time. Such a color maintenance composition may thus reduce and/or prevent the fabric article from looking "old and worn".

The color maintenance composition may be applied to the fabric article as a treatment at any time, such as when the fabric article is new, before the fabric article's first laundering cycle, before any specific laundering cycle, in the rinse cycle during regular laundering, etc. In a preferred embodiment, the color maintenance composition is applied to a new fabric article before its first laundering cycle, so as to lock in as much dye as possible. More preferably, the color maintenance composition is applied to the fabric article before the fabric article's first laundering cycle and in one or more subsequent laundering cycles, so as to repeatedly lock dyes into the fabric article, to continuously protect fabric from build up of fugitive dye redeposition, and/or to protect fibers from effects of repeated abrasion. Without intending to be limited by theory, it is believed that such a method of caring for a fabric article may substantially prolong the duration that a fabric article's colors remain bright and/or vivid. The color maintenance composition will preferably be applied to the fabric article by soaking it in a neat, or a diluted solution of the color maintenance composition.

Specific, non-limiting examples of the color maintenance composition useful herein include those described in WO 00/15745 to Littig, et al., published on Mar. 23, 2000; and WO 00/15746 to Littig, et al., published on Mar. 23, 2000.

The dryer sheet composition useful herein is typically provided to reduce the static charge of the fabric article by modifying the surface properties of the fabric article so as to reduce its charge. Many fabric softening actives described above with respect to fabric conditioning compositions may also be useful in a dryer sheet composition, as they may help reduce static charges, in addition to providing softness benefits. The dryer sheet composition may be applied to the fabric article at any point in the drying process. A preferred dryer sheet composition useful herein includes those described in U.S. Pat. No. 5,942,286 to Godfroid, et al., issued on Aug. 24, 1999; U.S. Pat. No. 5,929,026 to Childs, et al., issued on Jul. 27, 1999; U.S. Pat. No. 5,883,069 to Childs, et al., issued on Mar. 16, 1999; U.S. Pat. No. 5,804,547 to Godfroid, et al., issued on Sep. 8, 1998; and U.S. Pat. No. 5,578,234 to Corona, et al., issued on Nov. 26, 1996.

The finishing composition useful herein is characterized in that it is typically applied to the fabric article as one of the last steps prior to use (e.g., wearing) and/or in-between uses. The finishing composition provides the fabric article with one or more desirable properties such as crispness, wrinkle reduction, shape maintenance, color enhancement, whiteness enhancement, improved in-wear comfort, malodor reduction/prevention, stain protection, a desirable scent, fiber integrity maintenance, etc. The finishing composition is typically an ironing composition, a fabric styling composition, a wrinkle reduction composition, a stain prevention composition, or a combination thereof.

Preferred finishing compositions useful herein may include active compounds such as starch, a silicone compound, a cationic surfactant, a polymer, and a mixture thereof, at from about 0.1% to about 33%, preferably from about 0.5% to about 20%, and more preferably from about 1% to about 10%, by weight of the finishing composition.

In particular, a silicone compound is highly preferred in a finishing composition, as it is known to provide smooth ironing benefits, lubricity, and shape retention benefits. The silicone compound useful herein includes silicone gels, silicone surfactants, silicone fluids, silicone gum, and cross-linked silicone resins, as well as both linear silicones and branched silicones. Without intending to be limited by theory, it is believed that these silicones form cross-linked silicon-oxygen, silicon-amine, silicon-epoxy, and/or silicon-carboxy linkages to provide highly desirable wrinkle-reduction and ironing benefits. Useful silicones include the curable amine-functional silicones of EP 0 378 871 A2 to Coffindaffer, published on Jul. 25, 1990; and U.S. Pat. No. 4,419,391 to Tanaka, et al., issued Dec. 6, 1983. Such silicones are available from Dow Corning (USA), as Silicone 531 and Silicone 536; General Electric (USA), as SF 1706. Specific examples of a preferred silicone gum includes polydimethylsiloxane (PDMS), poly(dimethylsiloxane methylvinylsiloxane) copolymer, poly(dimethylsiloxane diphenylsiloxane methylvinylsiloxane) copolymer and mixtures thereof.

A highly preferred silicone surfactant useful in the finishing composition is a silicone copolymer which is thought to provide significant wrinkle reduction, ease of ironing, fabric smoothness, and fabric softness benefits by reducing the coefficient of friction between the fabric article's fibers, as well as between the fabric article and an iron, or between the fabric article and the skin. Such silicone copolymers are available as SILWET® from CK Witco Corporation, South Charleston, W.Va., USA, from Goldschmidt GMBH, Essen, Germany, and Dow Corning, Auburn, Mich., USA. Even more preferred silicone copolymers useful herein include SILWET® L-7001 (MW=about 20,000) and SILWET® L-7200 (MW=about 19,000) from CK Witco Corp.

Another highly preferred compound useful in the finishing composition is a copolymer of acrylate and methacrylate, preferably having an acrylate:methacrylate ratio of about 1:2 to 2:1, and more preferably having an acrylate:methacrylate ratio of about 1:1 and a molecular weight of about 250,000 to about 500,000. Such copolymers may provide excellent crispness and tensile properties, while minimizing fabric stiffness, which some consumers find undesirable. Such copolymers are available from, for example, BASF Aktiengesellschaft, Ludwigshafen, Germany, as LUVIMER SOFT™.

If malodor reduction is desired in the finishing composition, then a perfume, properfume, and/or a malodor reducer may be included. Especially useful malodor reducers include those that absorb malodors, such as a cyclodextrin, and antimicrobial compounds which kill the germs and microorganisms which may cause bad odor. Preferably a modified cyclodextrin and/or an anti-bacterial agent, and more preferably a methylated cyclodextrin, a hydroxypropyl beta cyclodextrin, an anti-bacterial agent, and a mixture thereof is included as a malodor reducer. Such cyclodextrins are available from, for example, Cerestar International, Neuilly-sur-Seine, France.

The finishing composition may also include an aromatic composition which delivers a selectable, and/or personalizable, desirable scent to the fabric article. Such a scent may be then gradually released as the fabric article is used, worn, and/or handled. Aromatic delivery systems useful herein are known in the art, and include sprays, pro-perfumes, absorption onto inert carriers, etc. The desirable scent applicable in the present invention includes essential oils, a perfume, herbal extracts, citrus scents, aromatherapy scents, and other scents known in the perfume art. The aromatic composition may be selected and/or personalized by referring to a computer profile, as discussed herein, or by otherwise collecting scent preference information from the consumer.

The finishing composition herein may also include a compound which protects the fabric article from future stains. Such compounds are known in the art, and may protect the fabric article, for example, by modifying its hydrophobicity/hydrophilicity, reducing the coefficient of friction, coating the surface with a polymer, etc.

Preferred finishing compositions useful herein include those described in U.S. Pat. No. 6,033,679 to Woo, et al., issued on Mar. 7, 2000; U.S. Pat. No. 6,001,343 to Trinh, et al., issued on Dec. 14, 1999; U.S. Pat. No. 5,997,759 to Trinh, et al., issued on Dec. 7, 1999; and U.S. Pat. No. 5,942,217 to Woo, et al., issued on Aug. 24, 1999.

In a highly preferred embodiment, the finishing composition acts as a fabric refresher composition and/or a home dry cleaning composition which, respectively, reduces odors, and/or reduces the need for dry cleaning of the fabric article. Highly preferred fabric refresher compositions are include those described in, U.S. Pat. No. 5,714,137 to Trinh, et al., issued on Feb. 3, 1998; U.S. Pat. No. 5,593,670 to Trinh, et al., issued Jan. 14, 1997; U.S. Pat. No. 5,939,060 to Trinh, et al., issued on Aug. 17, 1999. A home dry cleaning apparatus or kit may also be included herein, especially those described in, for example, U.S. Pat. No. 5,789,368 to You, et al., issued on Aug. 4, 1998; and U.S. Pat. No. 5,762,648 to Yeazell, issued on Jun. 9, 1998.

In a preferred embodiment, the finishing composition is provided as a spray-on finishing composition, especially a spray-on ironing composition. Such a finishing composition may be easily applied to the fabric article, evenly applied across the fabric article, specifically applied to a limited portion of the fabric article, etc.

The pre-treating composition useful herein is typically applied to a specific portion of the fabric article for the purpose of removing a specific undesirable compound a fabric article, such as a spot, ground-in-soil, a stain, a discoloration, an odor, etc., which the regular laundering process may not completely remove. A pre-treating composition may contain therein one or more surfactants, enzymes, bleaches, and/or solvents for a specific type of stain, etc., but is primarily distinguished from a laundry detergent composition and/or a fabric conditioning composition in that it is intended to be specifically applied to a portion of the fabric article, before the entire fabric article is subjected to the laundering cycle. The fabric treatment instructions will typically include a recommendation that the pre-treatment composition be directly applied, in either neat or diluted form, to the undesirable compound on the fabric article.

Preferred pre-treating compositions useful herein include a spot-treater, a bleach, an enzyme composition, a stain remover, and a mixture thereof. Such pretreating compositions are preferably in a solid form, a stick-like form, a liquid form, or a gel form.

The fabric treatment composition is provided in a fabric treatment composition container, such as a box, a bottle, and/or a pouch, which may further contain a dosing device and/or an applicator device such as a scoop, a measuring cup, a pour spout, etc. Solid and granular fabric treatment compositions are typically provided in a box or a bottle, preferably a cardboard box or a plastic box, and more preferably a laminated cardboard box, or a plastic box. Without intending to be limited by theory, it is believed that a laminated cardboard box and/or a plastic box may be especially advantageous, as these boxes may be easily recyclable, and may also be adjusted to provide desirable properties, such as a watertight seal, moisture resistance, reclosability, etc. Liquid and gel-type fabric treatment compositions are preferably provided within a plastic bottle, more preferably a recyclable plastic bottle such as a polyethylene and/or polypropylene bottle. The fabric treatment composition may also be provided in a pouch, especially a refill pouch.

The fabric treatment composition, especially a pre-treating composition and/or a finishing composition, is preferably provided with, or provided in, a container which includes an applicator which further provides a cleaning or fabric enhancement benefit. For example, a scoop, a measuring cup, a pour spout, a brush, or scrubber may be provided, either as part of the container, or separately, to enhance application of the pre-treating composition to the fabric article, and/or a specific portion thereof. Without intending to be limited by theory, it is believed that an applicator enhances contact between the pre-treatment composition and the fabric article, so as to more effectively remove the undesirable compound. Furthermore, convenience is enhanced, and physical agitation may significantly loosen, or dislodge the undesirable compound from the fabric article, with minimal effort and inconvenience to the user. Particularly useful applicators herein include those which simultaneously deliver the product, and provide a cleaning or fabric enhancement benefit, especially a brush, a membrane or scrim, a sprayer, a natural or artificial sponge, a luffa sponge, and/or a nylon/plastic "puff". It is highly preferred that the applicator be connected to a reservoir in which the fabric treatment composition is stored prior to application to the fabric article. Highly preferred pre-treatment devices are described in WO 99/37849 to Deflander, et al., published on Jul. 29, 1999; WO 98/16438 to Fukushima, et al., published on Apr. 23, 1998; WO 98/16623 to Shindo, et al., published on Apr. 23, 1998; and WO 98/16148 to Fukushima, et al., published on Apr. 23, 1998.

The compositions herein are each provided within their own separate containers; thus, the laundry detergent composition is provided within a laundry detergent container, the fabric conditioning composition is provided within a fabric conditioning container, and the fabric treatment composition is provided within a fabric treatment container.

Coordinated Element

To facilitate consumer recognition, improve ease of use, and/or to reduce the chance of undesirable interactions, the fabric treatment composition and the laundry detergent composition, the fabric conditioning composition, and/or the second fabric treatment composition, etc. contain a coordinated element. This coordinated element may serve to remind the consumer that the multiple products herein are to be used in combination with each other, and/or may actually provide improved, or synergistic results when applied to a fabric article. Thus, the coordinated element useful in the multiple products in the kit herein includes a brand name, a characteristic ingredient, container graphics, containers, dosages per container, a dye, a perfume, a trade dress, and/or a set of usage instructions; preferably a characteristic ingredient, container graphics, containers, a dye, a perfume, and/or a set of usage instructions; and more preferably a characteristic ingredient, a dye, a perfume, and/or a set of usage instructions. Thus, the multiple products in the kit are "coordinated" in that the referred-to products, product containers, and/or product formulations are specifically designed to be used and/or sold together, and to be compatible, complementary, synergistic, and/or easily recognizable as being part of the same system and/or kit.

A brand name may significantly increase consumer recognition that the multiple products in the kit herein may provide a synergistic benefit when used in combination with each other. Without intending to be limited by theory, it is believed that when a single brand name is used for multiple products, it is a recognizable signal which is easily conceptualized by the consumer. Furthermore, a brand name may reinforce to the consumer that the various products are intended to be used together, and alert a consumer to the potential synergies which may occur with use of the entire kit herein.

The characteristic ingredient is useful herein is a single active ingredient which is present in the multiple products in the kit. Such a characteristic ingredient may signal to the consumer that the multiple products herein are to be used together. Furthermore, it is believed that by repeatedly applying a characteristic ingredient at multiple stages in the fabric treatment cycle, significant cumulative, and/or synergistic benefits may be achieved. The characteristic ingredient may be selected from any ingredient useful in a fabric care composition, preferably a fabric softener active, an anti-static active, an antimicrobial active, a deodorizing active, a perfume, and a combination thereof. The characteristic ingredient may be present at the same level, or different levels in each of the multiple products herein.

The coordinated element may also be container graphics and/or containers which are inter-related, similar, and/or identical. As with the brand name above, similar or identical container graphics/containers may easily and recognizably indicate to a consumer that the multiple products herein may provide synergistic results when used in combination with each other. Preferably, the containers useful herein have a similar design, shape, color or colors, construction material, and/or functional characteristic which reinforces to a consumer that the multiple products herein are part of a kit. For example, similar or identical caps, bottle shapes, applicators/pour spouts, dosing devices, etc.

In an alternative embodiment, the containers in the kit of the present invention are inter-related in that they physically fit together to reduce wasted space, and to further imply that they are to be used together to provide superior results. For example, the containers for the multiple products herein may be designed, sized, and/or manufactured with the kit in mind, such that they are easily stacked, connected, organized etc. Thus, it is preferred that these containers physically fit together with a minimum of wasted space. This allows more kits to be placed within a given volume of space and thereby reduces the per unit storage space, shelf space, etc. required by the manufacturer, the distributor, the seller, and/or the consumer. This is especially preferred in locations where space is expensive or at a premium, as for example, on a convenience store shelf or in a consumer's storage space.

The coordinated element useful herein may also include the dosages per container, such that the multiple products herein are preferably completely consumed at about the same time. By coordinating the dosages per container according to a consumer's typical product usage cycle, complexity for the consumer and product waste can be reduced. Coordinating the dosages per container may further enhance the functionality of the kit herein, by reinforcing the recommended dosing and usage rates. This may help assure that the optimal amount of each of the multiple products herein is applied to the fabric article in the consumer's laundering cycles. Thus, coordinating the dosages per container may significantly reduce incidences of "underdosing" (which leads to sub-optimum performance) and overdosing (which leads to waste) by the consumer.

In a highly preferred embodiment, the dosages per container are personalized for the consumer. For example, a consumer profile may be used and/or cross-referenced with a mathematical algorithm, a consumer profiling database, a statistical analysis, etc. to determine the consumer's typical, or expected usage of the multiple products herein. This consumer profile, in turn, may be used to provide the consumer with a personalized kit containing the appropriate amount of each of the multiple products.

The dye useful herein as a coordinated element may be one or more dyes, typically non-staining water-soluble dyes, which modify the aesthetics of the multiple products in the kit, so as to signal to the consumer that the multiple products are to be in combination with each other. Thus, the dye may be a single dye, or a combination of dyes. The dye herein or the level thereof may further be adapted to color-code the multiple products in the kit, for example, to provide an indication to the consumer of the order of addition, activity level, and/or purpose of each of the multiple products.

The perfume useful herein as a coordinated element may be a single perfume, or a combination of perfumes which provide a consistent and/or synergistic odor for the multiple products herein. The perfume in each of the multiple products herein is coordinated so as to be aesthetically compatible with each other. For example, the perfume in the multiple products may be coordinated to provide an additive effect as each product is applied to the fabric article. Conversely, the perfume may be coordinated to provide a maximum perfume strength when the multiple products in the kit are applied to the fabric article; this is extremely preferred in locations where strongly perfumed fabric articles are disliked by consumers. The perfume herein may be the same perfume in each of the multiple products, as this may be a significant consumer-noticeable indication that the multiple products in the kit are to be used in combination with each other. Alternatively, the perfume in each of the multiple products may be different, but specifically coordinated to provide a final, consumer-desirable odor on the fabric article after a combination of the multiple products herein are applied thereto.

If present, the perfume is preferably a personalized aromatic composition, as described above, and is the same, in all of the multiple products in the kit.

The coordinated element useful herein may be a trade dress which distinctly indicates to the consumer that the multiple products herein are part of the same kit, and that they are therefore to be used in combination with each other. As used herein, the term "trade dress" indicates the total appearance and image of the multiple products in the kit herein. This term encompasses a combination of physical features such as the size, texture, shape, color and color combinations, graphics, packaging material, etc.

The coordinated element may also be a set of usage instructions which are attached to the kit and/or one or more of the multiple products therein. Without intending to be limited by theory, it is believed that such a set of usage instructions is highly preferred, because it may significantly decrease or eliminate the chance of undesirable interactions, and specifically instruct the consumer how to use the kit herein. The set of usage instructions will thus typically include a set of fabric treatment instructions, and a set of laundering instructions, a set of fabric conditioning instructions, and/or a set of second fabric treatment instructions.

The set of usage instructions may be provided in virtually any location and in any form (e.g., visual, audio, tactile such as braile, etc.), as long as it is perceivable to a consumer purchasing the kit. Thus, the set of usage instructions may be provided in the kit, and/or on a location such as a pamphlet, a computer screen, a printed ticket, a kiosk, a sign, a product container, an advertisement, a product display, an Internet website, a video, and a combination thereof, preferably the set of usage instructions are provided on a product container, a product display, or a combination thereof, as these locations are easy to reference. More preferably, the set of usage instructions are provided in the kit and/or on the containers for the multiple products, as the set of usage instructions is thus unlikely to become lost and/or separated from the relevant composition when it is needed.

The set of usage instructions typically includes a recommendation to use the fabric treatment composition in combination with the laundry detergent composition, a fabric conditioning composition, and/or a second fabric treatment composition. More preferably, the set of usage instructions contain a recommendation to use a laundry detergent composition before a fabric conditioning composition, and in combination with the fabric treatment composition.

In a preferred embodiment, the set of laundering instructions also contain a reference to the fabric treatment composition, the laundry detergent composition, the fabric conditioning composition, and/or a second fabric treatment composition. More preferably, the reference is the actual name of the multiple products in the kit. Without intending to be limited by theory, it is believed that such a reference may significantly reduce consumer confusion and undesirable cross-reactions and interactions between incompatible ingredients.

In addition to any of the above recommendations, the set of usage instructions will typically also include general instructions which recommend how to apply each of the multiple products to a fabric article, e.g., indirectly by adding the laundry detergent composition to an automatic washing machine prior to the beginning of the wash cycle.

Furthermore, depending upon the typical use of the fabric treatment composition, the set of usage instructions may include a pre-laundering recommendation, a post-laundering recommendation, a pre-conditioning recommendation, a post-conditioning recommendation, or a combination thereof. As used herein, a "pre-laundering recommendation" is a recommendation to use the fabric treatment composition before a laundry detergent composition. As used herein, a "post-laundering recommendation" is a recommendation to use the fabric treatment composition after a laundry detergent composition. As used herein, a "pre-conditioning recommendation" is a recommendation to use the fabric treatment composition before a fabric conditioning composition. As used herein, a "post-conditioning recommendation" is a recommendation to use the fabric treatment composition after a fabric conditioning composition.

If a laundry detergent composition is provided, and the fabric treatment composition is a dryer sheet composition, a finishing composition, a color maintenance composition, or a combination thereof, then it is highly preferred that the set of usage instructions includes a post-laundering recommendation to use the fabric treatment composition after the laundry detergent composition. Conversely, if a laundry detergent composition is provided and the fabric treatment composition is a bleaching composition, a color maintenance composition, a pre-treating composition, or a combination thereof, preferably a color maintenance composition, a pre-treating composition, or a combination thereof, then it is highly preferred that the set of usage instructions includes a pre-laundering recommendation to use the fabric treatment composition before the laundry detergent composition.

If a fabric conditioning composition is provided, and the fabric treatment composition is a bleaching composition, a color maintenance composition, a pre-treating composition, or a combination thereof, preferably a color maintenance composition, a pre-treating composition, or a combination thereof, then it is highly preferred that the set of usage instructions includes a pre-conditioning recommendation to use the fabric treatment composition before the fabric conditioning composition. Alternatively, if a fabric conditioning composition is provided and the fabric treatment composition is a dryer sheet composition, a finishing composition, a color maintenance composition, or a combination thereof, preferably a finishing composition, a color maintenance composition, or a combination thereof, then it is highly preferred that the set of usage instructions includes a post-conditioning recommendation to use the fabric treatment composition after the fabric conditioning composition.

In a highly preferred embodiment, the coordinated element, preferably the perfume, the container, the dosages per container, and/or the dye, is a personalized coordinated element. More preferably, the set of usage instructions is a set of personalized instructions. Such a personalized coordinated element, especially a set of personalized instructions, may be provided by, for example, collecting from the consumer one or more pieces of personal data, such as name, address, email address, clothing characteristics, usage characteristics, water hardness conditions, family member characteristics, packaging preferences, color preferences, scent preferences, fabric article preferences, cleaning preferences or cleaning needs, laundering frequency, whether or not the consumer owns a water softener, etc.; determining a consumer profile by employing a mathematical algorithm, a consumer profiling database, a statistical analysis, etc.; and providing to the consumer a kit with the multiple products, each of which includes the personalized coordinated element. More preferably, a set of personalized instructions is provided either directly, or indirectly. The set of personalized instructions may be provided via, for example, a printed label, an email message, a printed sheet of instructions, an Internet website, direct or indirect conveyance to the consumer's home and/or to a laundering appliance, etc.

Examples of the invention are set forth hereinafter by way of illustration and are not intended to be in any way limiting of the invention.

EXAMPLE 1

A kit according to the present invention includes a liquid laundry detergent composition, a clear, liquid fabric conditioning composition, and a color maintenance composition are provided in three separate containers, for use on a fabric article. All three containers are further packaged within a cardboard box to form the kit of the present invention. The kit includes a set of usage instructions which specifically refer to the fabric conditioning composition, the laundry detergent composition, and the color maintenance composition by name.

The set of laundering instructions also recommend that best results are achieved when the consumer uses the laundry detergent composition in combination with the fabric conditioning composition and the color maintenance composition. The fabric conditioning composition has a similar set of instructions which refer to both the laundry detergent composition and the color maintenance composition by name. The color maintenance composition has a set of fabric treatment instructions which refers to both the laundry detergent composition and the fabric conditioning composition by name, and also has a fabric treatment recommendation to use the color maintenance composition in combination with the laundry detergent composition and the fabric conditioning composition. The fabric treatment recommendation contains a pre-laundering recommendation and a pre-conditioning recommendation that the best results are achieved by using the color maintenance composition before the first laundering cycle for new garments and before the conditioning cycle for succeeding uses, so as to lock in the colors and repeatedly protect the fibers of the fabric article from abrasion.

The color maintenance composition container, the laundry detergent composition container, and the fabric conditioning composition container have a similar construction, in that they are made of the same plastic material, similar graphics, and a similar shape; however, the sizes are different. The number of dosages of the laundry detergent composition and the fabric conditioning composition are equal, at about 30 dosages, while the color maintenance composition has about 35 dosages.

EXAMPLE 2

A kit is provided as in Example 1, except that the color maintenance composition is replaced with a spray-on fabric refresher, which has a post-laundering recommendation and a post-conditioning recommendation. All containers have the same brand name and almost identical graphics. All compositions have similar aesthetics, such as color, and perfume.

EXAMPLE 3

A kit is provided as in Example 1, except that the color maintenance composition is replaced with a spray-on ironing and wrinkle reduction composition which has a post-laundering recommendation and a post-conditioning recommendation. All containers have the same brand name and almost identical graphics. All compositions have a similar perfume.

EXAMPLE 4

A granular laundry detergent composition, a liquid fabric conditioning composition, a dryer sheet, a color-safe bleach, a color maintenance composition, a spray-on ironing composition, a fabric refresher composition, and an enzymatic stain remover are provided in a single fabric care kit. All compositions are packaged within individual containers, which easily fit together within a cardboard box to form the fabric care kit. The kit is thus convenient and easy to store, stack, display, etc. Furthermore, all containers have a similar shape, the same brand name, and almost identical graphics, all of which are reproduced on the outside of the kit.

All compositions have similar aesthetics, such as color, and perfume. The enzymatic stain remover includes a separate pre-treatment applicator consisting of a reservoir and a soft brush-type applicator for scrubbing the fabric article. The compositions are applicable on all types of natural and artificial fabrics, such as those made of cotton, nylon, rayon, wool, and silk.

A set of usage instructions is provided on the side of the kit, which refers to each of the laundry detergent composition, the fabric conditioning composition, the bleaching composition, the color maintenance composition, the dryer sheet composition, the finishing compositions, and the pre-treatment composition by name, and further recommends that these compositions be used in combination with each other, for superior fabric care results. Each individual container also contains a set of general usage instructions for the composition contained therein.

Such a fabric care system is easily understood and conceptualized by the consumer, who may easily select the desired components while being assured that they are mutually compatible, and will give the desired results. When used as recommended, the fabric care kit provides bright whites and vivid colors, as well as stain and odor removal and improved cleaning. Fabrics and clothes to which the entire system are applied are soft, wrinkle-free, and have reduced static. Furthermore, after multiple washing cycles, the colors are noticeably brighter and more vivid and the fabric articles are newer-looking, as compared to a regularly-laundered fabric article.

EXAMPLE 5

A laundry detergent composition, a fabric conditioning composition, a bleaching composition, a color maintenance composition, a dryer sheet composition, a finishing composition, and a pre-treatment composition are provided as a fabric care kit as in Example 4, except that the set of usage instructions is located on a printed ticket which also includes a coupon which offers a discount when at least two compositions are purchased together. When a consumer approaches the shelf, a coupon printer located on the shelf automatically prints the printed ticket.

EXAMPLE 6

A laundry detergent composition, a fabric conditioning composition, a bleaching composition, a color maintenance composition, a dryer sheet composition, a finishing composition, and a pre-treatment composition are provided as a fabric care kit as in Example 4, except that the set of usage instructions is located on a kiosk's computer display which is connected to an Internet website.

When activated, the kiosk's computer display shows a short video which recommends to the viewer that superior fabric care results are achieved when the fabric care system is used as instructed.

EXAMPLE 7

A laundry detergent composition, a fabric conditioning composition, a bleaching composition, a color maintenance composition, a dryer sheet composition, a finishing composition, and a pre-treatment composition are provided as a fabric care kit as in Example 6, except that the kit is located on a stand-alone kiosk containing a computer with a touch-sensitive screen for entering data. The computer is connected to a consumer profiling database located on the Internet.

At the computer, the consumer is asked to enter personal data, in order to produce a set of personalized instructions. The consumer is asked for personal information such as name, address, email address, clothing characteristics, usage characteristics, family member characteristics, scent preferences, fabric article preferences, cleaning preferences or cleaning needs, and laundering frequency. The computer gathers the personal data provided and generates a consumer profile by using a mathematical algorithm to correlate the personal data entered with that stored in the consumer profiling database. In addition, the computer determines the likely water hardness by cross-referencing the consumer's address with known databases describing local water hardness and conditions.

The consumer profile is then used to generate a set of personalized instructions for the consumer. The set of personalized instructions is provided on one or more computer-printed adhesive labels which the consumer is instructed to attach to one or more of the laundry detergent composition container, the fabric conditioning composition container, and/or the fabric treatment composition container.

EXAMPLE 8

A laundry detergent composition, a fabric conditioning composition, a bleaching composition, a color maintenance composition, a dryer sheet composition, a finishing composition, and a pre-treatment composition are provided as a fabric care kit as in Example 7, and a set of personalized instructions are generated, as described. In addition, the set of personalized instructions are directly transmitted to the consumers' home computer, via the Internet, and from there to the consumer's home washing appliance.

EXAMPLE 9

A laundry shampoo composition, a fabric conditioning composition, and a fabric refresher composition are provided as a fabric care kit as in Example 2, except that the fabric treatment instructions recommend that the fabric refresher be used after the fabric article is laundered, conditioned, and dried. The fabric treatment instructions also recommend that the fabric refresher composition be used on occasions when the fabric article (e.g., a shirt) is used (e.g., worn) multiple times in-between laundering cycles. The fabric refresher composition effectively absorbs odors and refreshes the fabric article, thus reducing the need for laundering cycles. This in turn, enhances the longevity of the fabric article.

The laundry detergent composition container, the fabric conditioning composition container, and the fabric refresher composition container are further coordinated, in that their shapes are designed such that they physically fit together, as if they were three parts of a puzzle. This reduces wasted space, allowing more product to be packaged in a small space. This allows more kits to be placed within a certain volume of space, and thereby reduces the per unit storage space, shelf space, etc. required by the manufacturer, the distributor, the seller, and the consumer.

What is claimed is:

1. A kit for caring for a fabric article consisting of:

(a) a laundry detergent composition provided in a separate laundry detergent composition container, wherein the laundry detergent composition is a granule, a powder, a liquid, a gel, or a paste, wherein the laundry detergent composition comprises a builder and at least one detersive surfactant selected from the group consisting of an amphoteric surfactant, an anionic surfactant, a nonionic surfactant, a zwitterionic surfactant, and combinations thereof; and (b) a fabric treatment composition provided in a separate fabric treatment composition container, the fabric treatment composition comprises either:

(i) a liquid fabric conditioning composition applied to the fabric article during the rinse cycle, (ii) or a dryer sheet composition, wherein the fabric treatment conditioning composition comprises a fabric softening active selected from the group consisting of: an impalpable smectite clay, a silicone derivative, a cationic fabric softening active, and a mixture thereof;

wherein the laundry detergent composition and the fabric treatment composition comprise the following coordinated elements:

a perfume which is the same in the laundry detergent composition as in the fabric treatment composition, and an anti-microbial active which is the same in the laundry detergent composition and the fabric treatment composition, and wherein the perfume and the anti-microbial active are present at the same level in the laundry detergent composition and the fabric treatment composition.

2. The kit of claim 1, wherein the fabric treatment composition is a dryer sheet.

3. The kit of claim 1, wherein the coordinated element further comprises a brand name.

4. The kit of claim 3, where the coordinated element further comprises usage instructions.

5. The kit of claim 4, wherein the usage instructions of said laundry detergent composition comprise an instruction to use the laundry detergent composition in combination with the fabric treatment composition.

6. The kit of claim 5, wherein the usage instruction of said fabric treatment composition comprise an instruction to use the laundry detergent composition in combination with the fabric treatment composition.

7. The kit of claim 1, wherein the perfume of said laundry detergent composition and the perfume of said fabric treatment composition, provide a consistent odor on a treated fabric article.

8. The kit of claim 1, wherein the perfume of said laundry detergent composition and the perfume of said fabric treatment composition, provide an additive odor on a treated fabric article.

* * * * *